US009595150B2

(12) United States Patent
Fischer et al.

(10) Patent No.: US 9,595,150 B2
(45) Date of Patent: Mar. 14, 2017

(54) COIN SEPARATION DEVICE

(71) Applicant: Wincor Nixdorf International GmbH, Paderborn (DE)

(72) Inventors: Arno Fischer, Linz (AT); Markus Lindbichler, Mitterkirchen (AT); Hannes Ecklmayr, Neumarkt (AT)

(73) Assignee: WINCOR NIXDORF INTERNATIONAL GMBH, Paderborn (DE)

( * ) Notice: Subject to any disclaimer, the term of this patent is extended or adjusted under 35 U.S.C. 154(b) by 0 days.

(21) Appl. No.: 14/597,899

(22) Filed: Jan. 15, 2015

(65) Prior Publication Data

US 2015/0206368 A1 Jul. 23, 2015

(30) Foreign Application Priority Data

Jan. 17, 2014 (EP) ..... 14151598

(51) Int. Cl.
*G07D 1/00* (2006.01)
*G07D 3/14* (2006.01)
(Continued)

(52) U.S. Cl.
CPC ..... *G07D 3/14* (2013.01); *G07D 9/00* (2013.01); *G07D 9/008* (2013.01); *G07F 3/04* (2013.01);
(Continued)

(58) Field of Classification Search
CPC G07D 5/00; G07D 5/005; G07D 5/02; G07D 5/08; G07D 3/14; G07D 3/04;
(Continued)

(56) References Cited

U.S. PATENT DOCUMENTS 3,701,405 A * 10/1972 Fougere ..... C08K 7/12 194/324
3,757,918 A * 9/1973 Fougere ..... C08K 7/12 194/325
(Continued)

FOREIGN PATENT DOCUMENTS

DE 20 45 241 A1 3/1971
DE 23 34 076 A1 1/1974
(Continued)

OTHER PUBLICATIONS

English Translation of Abstract of JP 08301427A.*

*Primary Examiner* — Jeffrey Shapiro
(74) *Attorney, Agent, or Firm* — Maschoff Brennan

(57) ABSTRACT

A coin separation device comprises a conveying device for conveying coins in a conveying direction out of an input container along a conveying section and a testing device which is arranged on the conveying section for recognizing a coin type of a coin which is conveyed along the conveying section. An accelerating device is provided which is configured to accelerate a coin conveyed along the conveying section in dependence on recognition by the testing device in such a manner that the coin is conveyed from the conveying section into a coin collecting device, wherein the accelerating device is configured, in dependence on the coin type of the coin recognized by the testing device, to act upon the coin for acceleration.

12 Claims, 2 Drawing Sheets

(51) Int. Cl.

| | |
|---|---|
| ***G07D 3/00*** | (2006.01) |
| ***G07D 9/00*** | (2006.01) |
| *G07D 3/02* | (2006.01) |
| *G07D 3/06* | (2006.01) |
| *G07D 3/12* | (2006.01) |
| *G07D 13/00* | (2006.01) |
| *G07D 5/00* | (2006.01) |
| *G07D 5/08* | (2006.01) |
| *G07D 5/02* | (2006.01) |

(52) U.S. Cl.

CPC ..... *G07D 3/00* (2013.01); *G07D 3/02* (2013.01); *G07D 3/06* (2013.01); *G07D 3/128* (2013.01); *G07D 5/00* (2013.01); *G07D 5/005* (2013.01); *G07D 5/02* (2013.01); *G07D 5/08* (2013.01); *G07D 13/00* (2013.01); *G07D 2201/00* (2013.01)

(58) Field of Classification Search

CPC .. G07D 3/00; G07D 3/02; G07D 3/06; G07D 3/128; G07D 13/00; G07D 2201/00; G07D 9/00; G07F 3/04

USPC ..... 453/7, 11, 56; 194/302–304, 320, 328, 194/334; 235/379

See application file for complete search history.

(56) References Cited

U.S. PATENT DOCUMENTS

| | | | | | |
|---|---|---|---|---|---|
| RE28,827 | E * | 5/1976 | Fougere | G07D 3/00 | 194/325 |
| 6,412,620 | B1 * | 7/2002 | Imura | G06K 9/00 | 194/317 |
| 7,147,552 | B2 | 12/2006 | Schimpl | | |
| 7,591,362 | B2 | 9/2009 | Winau | | |
| 8,998,686 | B2 * | 4/2015 | Fischer et al. | 453/7 | |
| 2003/0168310 | A1 * | 9/2003 | Strauts et al. | 194/302 | |
| 2005/0277378 | A1 * | 12/2005 | Schimpl | G07D 9/008 | 453/18 |
| 2011/0174591 | A1 * | 7/2011 | Schimpl | G07D 5/10 | 194/342 |
| 2012/0285794 | A1 * | 11/2012 | Upton | G07F 5/02 | 194/344 |

FOREIGN PATENT DOCUMENTS

| | | | | |
|---|---|---|---|---|
| DE | 102 61 819 | A1 | 7/2004 | |
| EP | 0 660 274 | A1 | 6/1995 | |
| EP | 2 336 983 | A1 | 6/2011 | |
| EP | 2 525 330 | A1 | 11/2012 | |
| GB | 2 099 199 | A | 12/1982 | |
| JP | 08301427 | A * | 11/1996 | B65G 15/08 |

* cited by examiner

COIN SEPARATION DEVICE

CROSS-REFERENCE TO RELATED APPLICATION

This application claims priority to European Patent Application No. 14 151 598.1 filed on Jan. 17, 2014, the entirety of which is incorporated by reference herein.

BACKGROUND

The invention relates to a coin separation device as well as to a method for operating a coin separation device.

A coin separation device of this type includes a conveying device for conveying coins in a conveying direction out of an input container along a conveying section and a testing device which is arranged on the conveying section for recognizing a coin type of a coin which is conveyed along the conveying section.

In the case of a coin separation device of this type known from U.S. Pat. No. 7,147,552, a conveying device is provided in the form of a two-strand conveyor belt which realizes a conveying section, along which coins are conveyed out of an input container in an upward direction (against the effect of gravity). Entrainment means, which take the coins out of the input container and convey them along the conveying section, are arranged on the conveyor belt. Different devices, which are to ensure that only one single coin is conveyed on each entrainment means, are provided distributed along the conveying section. In dependence on recognition, the coins are conveyed into a coin collecting device, objects not recognized as coins being sorted out and returned to a user.

These types of coin separation devices serve for separating coins from other objects. A sorting device, which sorts coins separated by the coin separation device and directs them in sorted form into the collecting container, can be connected downstream of a coin separation device.

The separation device known from U.S. Pat. No. 7,147,552 B2 operates according to the so-called "vertical separation principle". In the case of the vertical separation principle coins are conveyed out of an input container, moved along a conveying section in an upward direction and, in dependence on coin recognition, are supplied to a coin collecting device. As a rule such coin separation devices are insusceptible to foreign bodies and can comprise a high level of recognition accuracy. By developing the conveying section in a suitable manner only coins, where possible, should be transported along the conveying section, whilst other objects remain in the input container. In dependence on recognition, recognized coins are then conveyed from the conveying section down into a coin collecting device so the coins can be processed further. In the case of the coin separation device known from U.S. Pat. No. 7,147,552 B2, an electromagnetic ejector is provided, for example, for conveying a recognized coin from the conveying section into a coin collecting device.

EP 2 525 330 A1 discloses a coin separation device where a coin can be ejected from a conveying device by means of an ejector element, which acts perpendicular to a conveying direction along an ejection direction, and in this way passes into a separation centrifuge. The ejector element acts perpendicular to the conveying direction along which the conveying device conveys coins. The trajectory of the coin is produced by overlapping the conveying movement of the coin and the acceleration which is effected perpendicular to the conveying direction by means of the ejector element.

GB 2 099 199 A discloses a conveying device with an acceleration device arranged thereon in the form of electric motors. The acceleration is effected in this connection in the same way for all coins, which can be used for the purpose of differentiating between different coins by way of their alloy by different types of coins being conveyed into different containers.

In the case of EP 0 660 274 A coins are conveyed into a coin channel by a rotating disk, it being possible using movable projection elements to let coins through as an option or, if a wrong coin is recognized, to convey it into an ejection opening.

DE 102 61 819 A1 discloses a device for sorting, counting or checking objects, in particular coins, where coins are able to be conveyed into a running section by means of an acceleration wheel.

SUMMARY

It is an object of the present invention to provide a coin separation device and a method for operating a coin separation device, both of which convey coins in a reliable manner from the conveying section into a coin collecting device.

Said object is achieved by a coin separation device with the features as described herein.

Accordingly, in the case of a coin separation device there is additionally provided an accelerating device which is configured to accelerate a coin conveyed along the conveying section in dependence on recognition by the testing device in such a manner that the coin is conveyed from the conveying section into a coin collecting device, wherein the accelerating device is configured, in dependence on the coin type of the coin recognized by the testing device, to act upon the coin for acceleration by the coin being accelerated in a first manner of acceleration if the coin has a first coin type, and in a second manner of acceleration which is different to the first manner of acceleration if the coin has a second coin type.

This proceeds from the concept of providing on the conveying section an additional acceleration device which accelerates a coin recognized as such out of the conveying movement and in this way centrifuges the recognized coin in the direction of a coin collecting device which is connected downstream. The acceleration device consequently serves for the purpose of accelerating a recognized coin out of the conveying movement such that the coin is conveyed from the conveying section in the direction of the coin collecting device.

The acceleration device, in this case, does not act in the same way on all the coins, but accelerates coins of different coin types according to different manners of acceleration. This is effected against the background that coins conveyed from the conveying section toward the coin collecting device which is connected downstream should preferably comprise an at least similar trajectory (flight path) in order to ensure that the coins, independently of their specific coin type and their physical characteristics connected thereto (size, weight), pass reliably in the same way into the coin collecting device.

In order to convey small, light coins and large, heavy coins along a similar trajectory, it is necessary to develop the acceleration device such that different coins are accelerated in a different manner.

For example, coins of a first coin type, for example coins with a low weight and accordingly low inertia, can be accelerated according to a first manner of acceleration by means of pulse acceleration. In this connection, an acceleration element of the acceleration device is situated prior to the acceleration of the coin in a position in which the acceleration element is at a spacing from the coin and then when the coin has reached a predetermined location on the conveying section, strikes against the coin in order to convey the coin from the conveying section in a pulse-like manner in this way.

In the case of coins of a second coin type, for example coins with a comparably high weight and accordingly high inertia, in contrast, for example, a second manner of acceleration is used in the form of sliding acceleration where the acceleration element of the acceleration device already abuts against the coin prior to the acceleration of the coin and is then accelerated in order to entrain the coin and convey it from the conveying section in this way.

However, it is also conceivable and possible for the manners of acceleration to differ simply in a transmitted pulse by a smaller pulse being exerted in the case of a light coin than in the case of a heavier coin. The important point in this context is only that, in dependence on a coin type of a coin, the acceleration element carries out an acceleration that differs from that of another coin of another coin type in order to accelerate coins of different coin types in a different manner in this way. The acceleration by the acceleration element is consequently not always the same for different coins with different coin types, but can differ.

A coin type within the framework of this text is to be understood as the denomination of a coin in a certain currency. For example, the Euro currency has the coin types "1 Euro coin", "2 Euro coin", "50 cent coin", "10 cent coin" etc. In dependence on its coin type a coin comprises a predetermined nominal size, predetermined electric characteristics and a predetermined nominal weight. The coin type of a coin is recognized by the testing device which comprises, for example, an optical sensor device for detecting the geometric dimensions of the coin and/or an electromagnetic sensor device for detecting electrical characteristics of the coin.

The testing device comprises, for example, an evaluation and storage device in which data of different coin types is stored in currency data sets. A coin can be assigned to a coin type by comparing measured, detected characteristics of a coin with data of a previously stored currency data set.

The acceleration of the coin by means of the acceleration device is effected in a preferred manner in the conveying direction. The acceleration device accelerating a recognized coin in the conveying direction is to be understood in the present case as the acceleration device exerting onto the recognized coin an acceleration force which is directed in the conveying direction at least with one direction vector component. The acceleration direction does not have to correspond precisely to the conveying direction, but can also be directed, for example, at an angle to the conveying direction insofar as just one direction vector component of the acceleration direction points in the conveying direction (i. e. the acceleration direction can be broken down into vector components, at least one of which points in the conveying direction).

However, in one specific advantageous development the acceleration direction, in which the acceleration device accelerates a recognized coin, is directed in a collinear manner to the conveying direction.

A recognized coin is consequently accelerated out of its conveying movement by means of the acceleration device, the acceleration in the conveying direction being in such a manner the speed to which a recognized coin is accelerated by means of the acceleration device is greater than the conveying speed at which the coin is conveyed along the conveying section by means of the conveying device. By means of the acceleration device a recognized coin is consequently accelerated forward (when seen in the conveying direction) out of its conveying movement and in this way is conveyed in the direction of a coin collecting device which is connected downstream.

A recognized coin is consequently conveyed from the conveying section toward the coin collecting device by means of the acceleration device. This enables reliable conveying of coins recognized as such toward a coin collecting device and can ensure in a reliable manner that only coins, not however other objects pass into the coin collecting device.

In an advantageous manner the conveying section comprises a first end and a second end, wherein the input container is arranged in the region of the first end and the acceleration device is arranged in the region of the second end. The acceleration device is then preferably configured to convey a recognized coin beyond the second end into the coin collecting device on the other side of the second end. A recognized coin is consequently accelerated beyond the second end by means of the acceleration device and in this way is moved from the conveying section in the direction of the coin collecting device, the coin collecting device being developed in a suitable manner to catch the coin.

In an advantageous development the coin collecting device—when viewed along the conveying direction—is at a spacing to the second end of the conveying section. The coin collecting device consequently does not connect directly to the conveying section, but is removed from the second end of the conveying section by a predetermined spacing. If a coin is accelerated by means of the acceleration device, it is thus centrifuged beyond the second end of the conveying section into the coin collecting device by overcoming the spacing, the acceleration force brought about by the acceleration device being dimensioned such that a recognized coin also reaches the coin collecting device by overcoming the spacing and consequently passes reliably into the coin collecting device. If, in contrast, a coin or another object is not accelerated or is not accelerated sufficiently, the coin or the object does not pass into the coin collecting device, but is, for example, conveyed through an opening formed by the spacing between the second end of the conveying section and the coin collecting device and in this way passes into a return device which is different from the coin collecting device. Non-recognized coins—for example counterfeit money or coins of another currency or such coins which are no longer able to be accepted by the coin collecting device (for example because the coin collecting device or individual containers of the coin collecting device are already full)—or other foreign bodies are consequently returned to a user and are not processed further in the coin collecting device which is connected downstream.

The acceleration device can comprise, for example, a stepping motor and an acceleration element, for example a rotary wheel, which is driven by the stepping motor for accelerating a coin. An acceleration element which is configured as a rotary wheel can be formed, for example, as a paddle wheel which is rotatable about a rotational axis having one or several paddles for acting upon a coin to be accelerated. During operation of the coin separation device the stepping motor drives the acceleration element—in dependence on the recognition of a coin by the testing device—by, for example, the paddle wheel being turned and, as a result of a paddle acting upon the coin to be accelerated, the coin being accelerated out of its conveying movement. The stepping motor, in this connection, is actuated incrementally in dependence on recognition by the testing device and consequently only moves the acceleration element when the testing device generates a suitable control signal which indicates the recognition of a coin. The acceleration is consequently effected in a selective manner: Only those coins which have been recognized and are to be supplied to the coin collecting device are accelerated.

When the coin separation device is arranged and used in the correct manner, the conveying direction is advantageously directed against a direction of gravity at least with one direction vector component. The coin separation device consequently operates according to the vertical separation principle by coins being conveyed out of the input container in an upward direction along the conveying section. The conveying device, in this connection, does not have to be directed precisely vertically against the direction of gravity (that is against the direction in which the force of gravity acts), but in an advantageous manner points at an angle with respect to the direction of gravity in such a manner that one direction vector component of the conveying direction is directed against the direction of gravity.

In an advantageous development the conveying device comprises a conveyor belt with two conveying strands which extend parallel to one another along the conveying direction and are moved in a synchronous manner. The conveying strands can be configured in each case by a circulating conveyor belt, the conveying strands being moved in a synchronous manner and consequently together conveying coins out of the input container. At least one entrainment means is arranged on each conveying strand for this purpose, one entrainment means of the one conveying strand and one entrainment means of the other conveying strand realizing a pair of entrainment means for entraining in each case one coin.

The acceleration element of the acceleration device is advantageously placed in such a manner relative to the conveying strands that—when viewed transversely with respect to the conveying direction—it is arranged between the conveying strands. To accelerate a coin, the acceleration element is consequently moved through between the entrainment means of the pair of entrainment means on which the coin to be accelerated is actually guided, acts upon a coin in this way and centrifuges it in the direction of the coin collecting device. By the acceleration element being moved through between the entrainment means, the acceleration element can act upon the coin to be accelerated in a defined manner and accelerate the same relative to the conveying strands such that the coin is conveyed from the conveying section in the direction of the coin collecting device.

The coin collecting device serves for catching the coins accelerated away from the conveying section. In an advantageous manner, the coin collecting device, in this connection, can comprise a sorting device for sorting the coins conveyed into the coin collecting device, said sorting device being configured in particular to direct each coin in dependence on its coin type into a coin collecting container assigned to the coin type. The coin type has already been recognized by the testing device of the conveying device such that the coin type of the coin is already established when it is conveyed into the coin collecting device by means of the acceleration device. In dependence on the coin type, the coin is then processed further and directed to a coin collecting container which is assigned to it such that, for example, a one Euro coin passes into a collecting container for one Euro coins.

The object is further achieved by a method for operating a coin separation device. The coin separation device includes a conveying device for conveying coins in a conveying direction out of an input container along a conveying section and a testing device which is arranged on the conveying section for recognizing a coin type of a coin which is conveyed along a conveying section. In this case it is provided that that an acceleration device accelerates a coin, which is conveyed along the conveying section and is recognized by the testing device, in the conveying direction in such a manner that the coin is conveyed from the conveying section into a coin collecting device, wherein the accelerating device, in dependence on the coin type of the coin recognized by the testing device, acts upon the coin for acceleration by the coin being accelerated in a first manner of acceleration if the coin has a first coin type, and in a second manner of acceleration which is different to the first manner of acceleration if the coin has a second coin type.

The advantages and advantageous developments described previously for the coin separation device are also applicable in an analogous manner to the method for operating the coin separation device. The method preferably serves for operating a coin separation device of the type described previously.

In an advantageous manner the acceleration device is actuated in dependence on a control signal generated by the testing device for accelerating a coin which is conveyed on a conveying section. The acceleration device is consequently actuated in a selective manner in dependence on recognition of a coin by the testing device, it being possible, for example, for a stepping motor of the acceleration device to be provided with current in a selective manner for this purpose in order to drive a suitable acceleration element, for example a paddle wheel, incrementally for accelerating a coin.

The testing device preferably comprises a sensor device which detects geometric and/or electric characteristics of the coin in order to determine the coin type of the coin by way of the geometric and/or electric characteristics. To this end, the testing device comprises, for example, an evaluation and storage device in which at least one currency data set with data of different coin types of a coinage is stored. The evaluation and storage device compares data on the coin detected by means of the sensor device with previously stored data of the at least one currency data set and by way of the comparison assigns the coin to a coin type of the currency data set. If the coin can obviously be assigned to a coin type and if consequently the coin type of the coin is identified, the acceleration device can be actuated in dependence on the coin type in order to accelerate the coin in a suitable manner in dependence on the coin type and as a result to convey it from the conveying section toward the coin collecting device.

In the case of the acceleration of different coins, it is a preferred aim for different coins of different coin types to comprise at least approximately a same flight path. A small, light coin (e.g. an aluminum coin) is to be conveyed at least approximately along a same flight path from the conveying section as a large heavy coin (e.g. a steel coin).

To this end, the manner of acceleration by way of which the acceleration device acts upon a coin is adapted in dependence on the coin type of the coin.

If the coin comprises, for example, a first coin type, a first manner of acceleration can be used where the acceleration device is accelerated out of a position in which an acceleration element of the acceleration device is at a spacing from the coin, strikes against the coin and as a result conveys the coin from the conveying section. As a result of such a pulse acceleration the coin is consequently conveyed away from the conveying section in a pulse-like manner by the acceleration device acting upon the coin in a pulse-like manner. Such a manner of acceleration can be used, in particular, in the case of small light coins.

If, in contrast, the coin has a second coin type, the acceleration device can be accelerated in a second manner of acceleration out of a position in which an acceleration element of the acceleration device abuts against the coin in order to entrain the coin and as a result convey it from the conveying section. In said second manner of acceleration the acceleration device consequently accelerates the coin as a result of it entraining the coin and conveying it from the conveying section as a result of its own acceleration. Such sliding acceleration can be used, in particular, in the case of large heavy coins. Such large heavy coins have a comparatively large degree of inertia. As a result of such sliding acceleration where an acceleration element of the acceleration device is first of all moved to abut against the coin in order then to be accelerated and to centrifuge the coin from the conveying section, the inertia pulse which acts upon the acceleration device as a result of the forces of inertia of the coin, is smaller than in the case of the pulse acceleration.

In the case of both the manners of acceleration, the acceleration device is preferably braked again after its acceleration in order to prevent a coin conveyed from the conveying section receiving a (further) pulse from the acceleration device which could cause the coin to deviate from its flight path.

BRIEF DESCRIPTION OF THE DRAWINGS

The concept underlying the invention is to be explained in more detail below by way of the exemplary embodiments shown in the figures.

DETAILED DESCRIPTION

Figure 1:
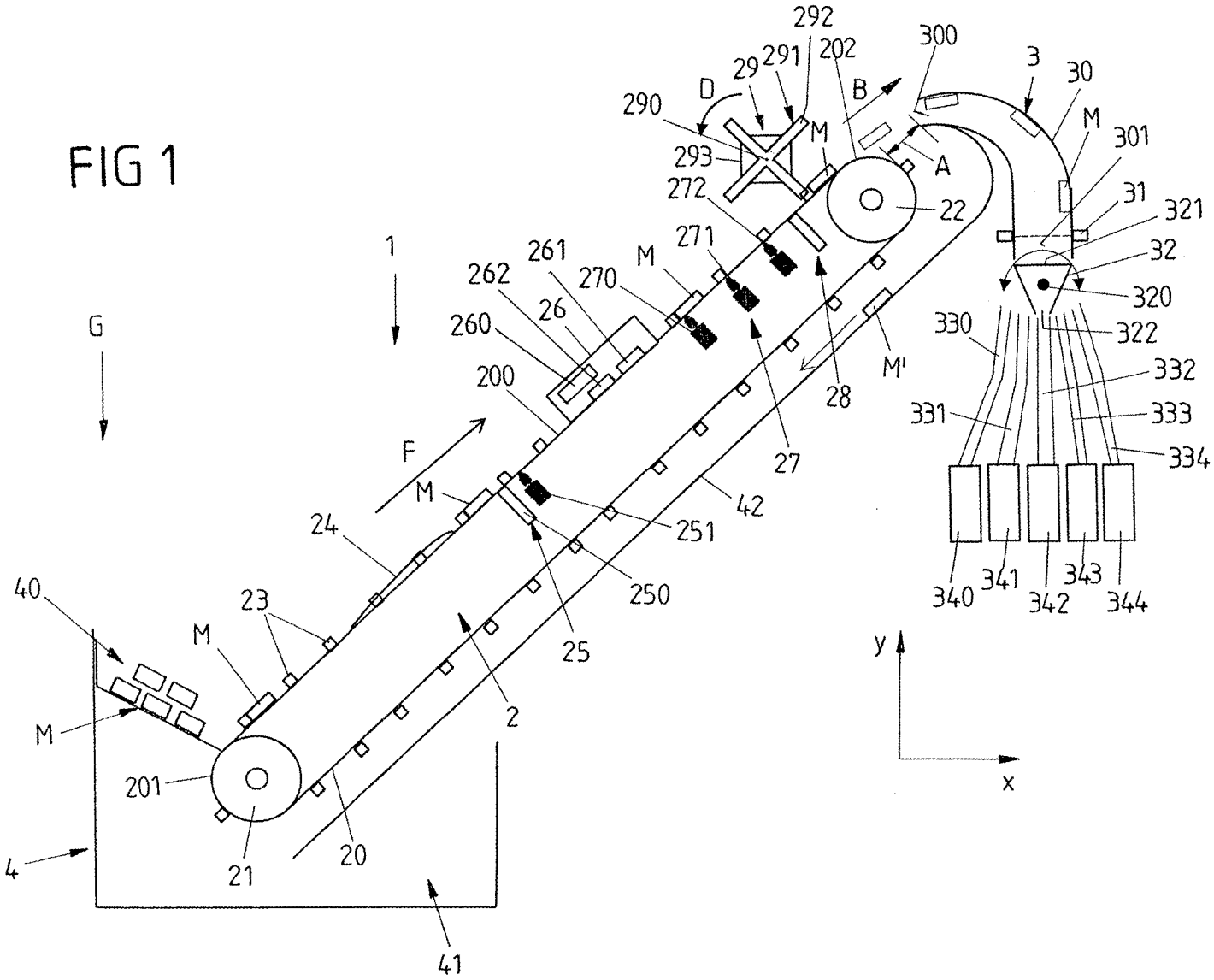
FIG. 1 shows a schematic view of a coin separation device with a conveying device and an acceleration device arranged on the conveying device for accelerating a coin out of its conveying movement, seen from the side.
Figure 2:
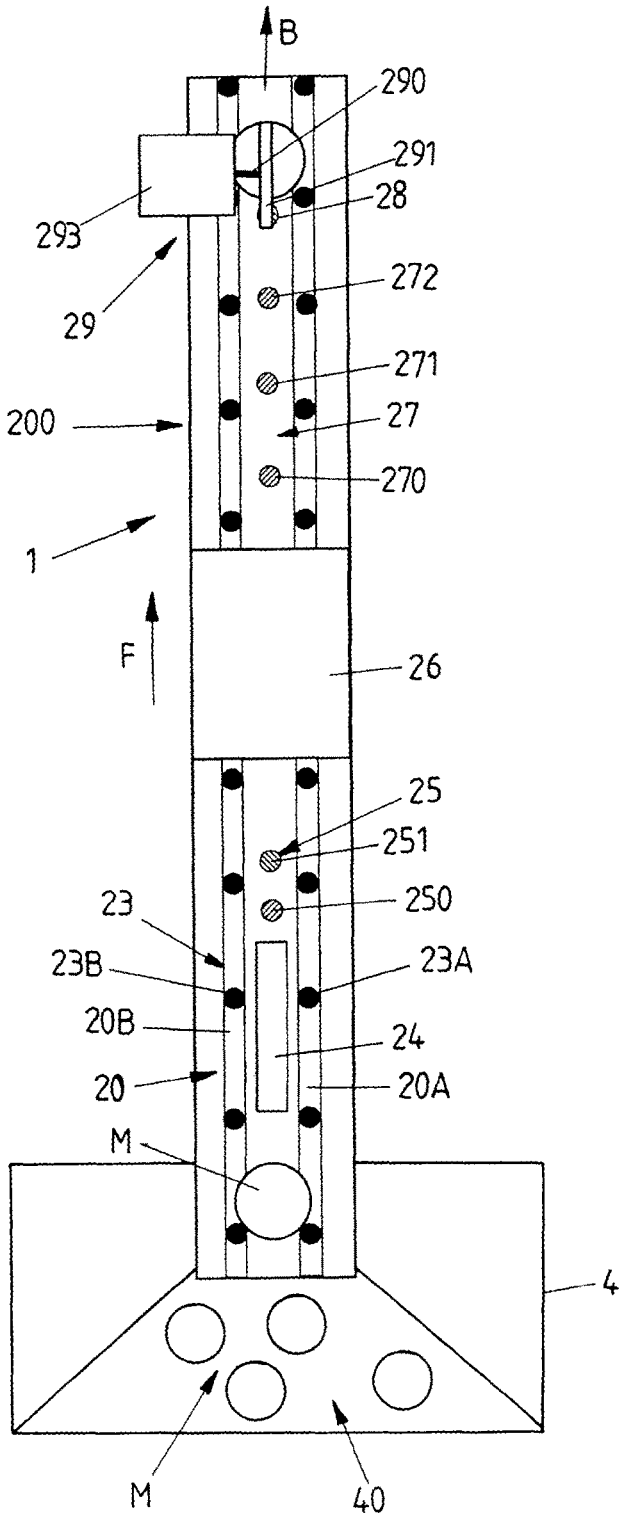
FIG. 2 shows a view of the conveying device and of the acceleration device according to FIG. 1, seen in a top view from above.

FIGS. 1 and 2 show an exemplary embodiment of a coin separation device 1 which comprises a conveying device 2 for conveying coins out of an input container 40 along a conveying section 200 toward a coin collecting device 3.

The conveying device 2 is realized as a conveyor belt with two conveying strands 20A, 20B which extend parallel to one another and are driven in a synchronous manner. Each conveying strand 20A, 20B, in this connection, is configured by a circulating conveyor belt, the conveying strands 20A, 20B being guided by identical guide elements 21, 22 in the form of guide rollers and being driven in a synchronous manner for movement in the same direction at the same speed.

The conveyor belt 20 which is formed by the conveying strands 20A, 20B serves for the purpose of conveying coins M out of the input container 40 in a conveying direction F along a conveying section 200. The conveying device 2, in this connection, realizes the so-called vertical separation principle by the conveying direction F being directed against the direction of gravity G with one direction vector component (i.e. the conveying direction F can be broken down into vector components, one of which is set up against the direction of gravity G). Coins M are consequently conveyed upward at an angle (that is upwardly) with reference to the direction of gravity G out of the input container 40 along the conveying direction F, pairs of entrainment means 23, which are configured in each case by one first entrainment means 23A which is arranged on the one conveying strand 20A and one second entrainment means 23B which is arranged on the other conveying strand 20B, being configured on the conveying strands 20A, 20B for this purpose.

To convey a coin M out of the input container 40, one pair of entrainment means 23 is moved through the input container 40 and in this way engages a coin M, which—as shown in FIGS. 1 and 2—comes to abut against the conveying strands 20A, 20B and is held between the entrainment means 23A, 23B of the pair of entrainment means 23. By moving the conveying strands 20A, 20B in the conveying direction F, the coin M is then moved along the conveying section 200 in the conveying direction F, the movement of the conveying strands 20A, 20B being effected continuously and consequently coins M being removed in a successive manner out of the input container 40 and conveyed along the conveying section 200.

When a coin M is taken out of the input container 40 several coins M can come to rest on one pair of entrainment means 23, for example by two coins lying one on top of the other or by one coin M pushing a further coin M in front of it on one pair of entrainment means 23.

Consequently, first of all a ramp 24 is arranged on the conveying section 200 and then connecting thereto in the conveying direction F an ejecting device 25 which is to ensure that only precisely one coin M is conveyed on each pair of entrainment means. If a coin M which is conveyed on a pair of entrainment means 23 reaches the ramp 24, it runs up it and is consequently offset (slightly) perpendicular to the conveying direction F on the pair of entrainment means 23 associated therewith. In this way the coin M is raised from the conveying strands 20A, 20B, which results in a second coin M which is arranged on the coin M sliding from the entrainment means 23A, 23B of the pair of entrainment means 23 and consequently falling from the conveyor belt 20.

After the ramp 24 the coin M passes to the ejecting device 25, which comprises a sensor 25 which is configured, for example, in an inductive manner and an ejector 251 which is connected downstream in the conveying direction F and is configured, for example, electromagnetically. If it is recognized by means of the (inductive) sensor 250 that a coin M is pushing a further coin M in front of it on a pair of entrainment means 23, the ejector 251 is actuated in a corresponding manner and the further coin is ejected.

After the ramp 24 and the ejecting device 25 it is consequently ensured that only precisely one coin M is conveyed on one pair of entrainment means 23. The coin M then passes to a testing device 26 which is arranged on the conveying section 200 and serves for the purpose of detecting a coin, that is to recognize whether it is a coin M which is to be processed further or it is another object, for example a foreign body or a coin which cannot be processed further (because it originates, for example, from another currency. In dependence on the recognition, which can be performed, for example, by way of diameter recognition, weight recognition or also optical pattern recognition, a control signal is generated which serves for actuating an acceleration device 29 which is connected downstream, as is to be explained again below.

After running through the testing device 26, a coin M passes to an ejecting device 27, which comprises ejectors 270, 271, 272 for the selective ejection of the coin M from the conveyor belt 20. Two of the ejectors 270, 271, 272, in this connection, serve for the purpose of ejecting coins M with extreme characteristics (e.g. extremely light or extremely heavy coins M or coins M with an extraordinary form, e.g. angular coins which cannot be accelerated in an optimum manner by way of the acceleration device 29 connected downstream). A third one of the ejectors 270, 271, 272 serves for the purpose of ejecting a coin M in a selective manner if the coin M has certainly been recognized and verified, then however it has been ascertained that the coin collecting device 3 connected downstream is not capable of accepting and processing the coin M further, for example because a container associated with the coin M is full and consequently is no longer able to accept further coins M.

After passing the ejecting device 27 with the ejectors 270, 271, 272, a coin M which is guided on a pair of entrainment means 23—if it has not been ejected up to now but has been recognized and verified by the testing device 26—is to be supplied to the coin collecting device 3 for further processing. The acceleration device 29, which is arranged in a fixed location with respect to the conveyor belt 20 of the conveying device 2 and comprises a stepping motor 293 which comprises by means of a rotational axis 290 an acceleration element 291 in the form of a paddle wheel with a number of individual paddles 292, serves for this purpose.

The acceleration device 29 is arranged on a second end 202 of the conveying section 200 of the conveying device 2 (the conveying device 2 takes the coins M out of the input container 40 on an opposite first end 201). The acceleration element 29 is rotatable about the rotational axis 290 and at the same time—when viewed in a transverse direction transversely with respect to the conveying direction F—is arranged between the conveying strands 20A, 20B and consequently spatially between the entrainment means 23A, 23B arranged thereon (see FIG. 2). The acceleration element 291 can consequently be moved through between the entrainment means 23A, 23B of a pair of entrainment means 23 in order, in this way, to act with one of its paddles 292 upon a coin M which is arranged on a pair of entrainment means 23.

In operation, the acceleration element 291 in the form of the paddle wheel is set incrementally into a rotational movement in a rotational direction D about the rotational axis 290 by means of the stepping motor 293. The actuation of the stepping motor 293 is effected in dependence on a control signal generated by the testing device 26 which indicates the correct recognition of a coin M and controls the stepping motor 293 in a corresponding manner for conveying the coin M into the collecting device 3. In the case of corresponding actuation, the stepping motor 293 consequently drives the acceleration element 291 in the form of the paddle wheel in the rotational direction D such that a paddle 292 acts upon the coin M to be accelerated and accelerates it in an acceleration direction B which is approximately the same direction as the conveying direction F.

The actuation of the acceleration element 291 of the acceleration device 29 is effected by the testing device 26 in this connection in a controlled manner in dependence on the coin type of a coin M conveyed on the conveying section 200. The coin type of a coin M is detected by the testing device 26 which comprises sensor devices 261, 262 and an evaluation and storage device 260 for this purpose. The geometric dimensions of a coin M can be detected in an optical manner by means of the sensor devices 261, 262, and, for example, using suitable electromagnetic cores, electric characteristics of the coin M can be determined. One or more currency data sets, in which data on coin types of one or several currencies are contained, are stored in the evaluation and storage device 260. By comparing data measured by means of the sensor devices 261, 262 with the data stored in the evaluation and storage device 260, a coin M can then be assigned to a coin type which is deposited in a currency data set such that a coin can be recognized, for example, as a "1 Euro coin", "2 Euro coin" or the like.

In dependence on its coin type, a coin comprises predetermined nominal physical characteristics, in particular a predetermined nominal weight (a 1 Euro coin comprises, for example, a predetermined nominal weight, from which the real weight of the 1 Euro coin will only deviate in a negligible manner). Such physical characteristics, in particular the weight and the size, are also stored in the associated currency data set such that by identifying the coin type of the coin M in particular its weight and size are also known.

In dependence on the coin type, the acceleration device 29 can consequently be actuated in such a manner that it accelerates the known coin M in an advantageous manner such it is conveyed along a suitable flight path to the left of the coin collecting device 3. The acceleration by the acceleration device 29, in this case, can be in such manner that the flight path for coins M of different coin types is at least approximately the same in order to ensure in this way that all the coins M pass in a reliable manner into the inlet 300 of a channel 30 of the coin collecting device 3.

In this connection the acceleration device 29 can be actuated in different ways in dependence on the coin types of different coins M.

For example, to accelerate a small light coin (e.g. an aluminum coin) the acceleration device 29 is actuated to carry out a first manner of acceleration where the acceleration element 291 in the form of the paddle wheel tracks the coin M at a spacing and then, if the coin M is situated approximately in the position shown for the coin M below by the acceleration element 291 in FIG. 1, strikes against the coin M such that the coin M is accelerated in a pulse-like manner and as a result is conveyed from the conveying section 200 toward the coin collecting device 3. The acceleration device 29 consequently acts upon the coin M in a pulse-like manner and knocks it from the conveying section 200.

In the case of a large heavy coin M (for example a steel coin) the acceleration element 291 in the form of the paddle wheel can track the coin M in contrast with a paddle such that the paddle abuts against the coin M and the coin M, where applicable, already lifts (slightly) from the pair of entrainment means 23 on which the coin M is conveyed. The acceleration element 291 in the form of the paddle wheel is accelerated out of said abutment position then when the coin M is situated in the position shown in FIG. 1 and at the same time entrains the coin M. The coin M is consequently accelerated in a sliding manner from the conveying section 200 toward the coin collecting device 3.

The provision of said specific different manners of acceleration is not compulsory. It is also conceivable to actuate the acceleration element 291 in the form of the paddle wheel for exerting a predetermined pulse upon a coin M in dependence on the coin type, the exerted pulse varying for coins M of different coin types.

In order to prevent, irrespective of the manner of acceleration, a paddle of the acceleration element acting (again)

upon on the already accelerated coin M after a coin M has been accelerated, the acceleration element 291 in the form of the paddle wheel is braked again once it has acted upon a coin M until the next coin M is to be conveyed away from the conveying section 200 and the acceleration element 291 is once again actuated for this purpose.

By means of the acceleration device 29 a coin M which is to be conveyed into the coin collecting device 3 is accelerated out of the conveying movement along the conveying section 200 and in this way is centrifuged into the inlet 300 of the channel 30 of the coin collecting device 3. The acceleration is effected in this connection out of the conveying movement and consequently at least approximately in the conveying direction F as a result of the coin M being accelerated in the conveying direction F to a speed which exceeds the conveying speed of the conveying device 2 along the conveying section 200 (brought about by the conveying movement of the conveyor belt 20 with its conveying strands 20A, 20B). The coin M is consequently accelerated beyond the second end 202 of the conveying section 200 and passes into the coin collecting device 3.

The coin collecting device 3 is at a spacing A from the second end 202 of the conveying section 200. The acceleration of the coin M is provided such that the accelerated coin M is able to overcome the spacing A and consequently passes into the inlet 300 of the channel 30.

The channel 30 is configured in a curved manner in the plane spanned by the conveying direction F and the direction of gravity G. In particular with its outside wall, which is remote from the conveying device 2, the channel 30, in this case, reproduces the (on account of the acting force of gravity parabolic) flight path of an accelerated coin M which is conveyed into the coin collecting device 3. The result of this is that a coin M centrifuged into the channel 30 moves in a sliding manner to abut against the outside wall of the channel 30 and is guided in a sliding manner along the outside wall such that a defined movement of the coin M along the channel is produced without the coin M, for example, getting into trouble.

An object M' (for example a defective body or a coin which is not to pass into the coin collecting device 3), which is still situated on the conveyor belt 20 at the second end 202 of the conveying section 200 and consequently has passed all the devices 24, 25, 26, 27, 28 on the conveying section 200 and has also not been accelerated by the acceleration device 29, is conveyed beyond the second end 202 of the conveying section 200, but in this case falls through the opening created by the spacing A between the second end 202 of the conveying section 200 and the inlet 300 of the coin collecting device 3 onto a chute 42, which conveys the object M' (see FIG. 1) back into a collecting container 41 of a return device 4 and consequently returns it to a user.

Arranged downstream of the ejecting device 27 in the conveying direction F on the conveying section 200 is a checking device 28 which serves for the purpose of checking the correct ejection of a coin M—if this should have been effected—at the ejecting device 27. The checking device 28 is developed, for example, as an inductive sensor which checks whether a metal coin M, which should have been ejected by the ejecting device 27, has also actually been ejected and to this end generates a signal inductively when the coin M possibly passes.

The coin collecting device 3 catches a coin M, which is centrifuged by means of the acceleration device 29 from the conveying section 200 toward the coin collecting device 3, at its inlet 300 and directs the coin M via the channel 30 toward a sorting device 32 in the form of a sorting funnel which is pivotable about a pivot axis 320. Before the coin M, in this case, passes to the sorting device 32, it passes a checking device 31 which serves the purpose of detecting the coin M in order to verify that the coin M has actually passed into the coin collecting device 3. In addition, when the coin M passes the checking device 31 (which can be configured, for example, as a light barrier), a position signal can be generated which can be used to trigger an adjustment movement of the sorting device 32 in order to direct the coin M into a coin collecting channel 330-334 and into a coin collecting container 340-344 which is connected downstream of the coin collecting channel 330-334 so that it can be sorted in a suitable manner.

When reaching the sorting device 32, the coin M passes into a funnel-shaped inlet 321 of the sorting device 32 and is supplied via an outlet 322 to the associated coin collecting channel 330-334 and via this to the associated coin collecting container 340-344.

For example, one coin collecting container 340-344 can be associated with each coin type. Thus, a one Euro coin can be directed, for example, into a coin collecting container 340-344 in which one Euro coins are collected. The same applies to coins of other coin types.

The concept underlying the invention is not limited to the exemplary embodiments depicted above, but can also be realized in principle in the case of quite different embodiments.

In particular, the acceleration direction into which the acceleration device accelerates a coin to be accelerated is not necessarily directed in a collinear manner with respect to the conveying direction. The acceleration direction can also be directed, for example, at an angle with respect to the conveying direction.

The acceleration device can be developed, in principle, in an arbitrary manner and does not necessarily have to use a paddle wheel. For example, the acceleration can be in quite a different manner, for example by means of compressed air or as a result of an electromagnetic ejecting device which (also) brings about acceleration in the conveying direction. In principle, all acceleration devices which are able to bring about acceleration out of the conveying movement are suitable.

LIST OF REFERENCES

1 Coin separation device
2 Conveying device
20 Conveyor belt
200 Conveying section
201, 202 End
20A, 20B Conveying strand
21, 22 Guide element
23 Pair of entrainment means
23A, 23B Entrainment means
24 Ramp
25 Ejecting device
250 (Inductive) sensor
251 Ejector
26 Testing device
260 Evaluation and storage device
261, 262 Sensor device
27 Ejecting device
270, 271, 272 Ejector
28 Checking device
29 Acceleration device
290 Rotational axis
291 Acceleration element (paddle wheel)

292 Paddle
293 Stepping motor
3 Coin collecting device
30 Channel
300 Entry
301 Exit
31 Checking device
32 Sorting device
320 Pivot axis
321 Inlet
322 Outlet
330-334 Coin collecting channel
340-344 Coin collecting container
4 Return device
40 Input container
41 Collecting container
42 Chute
A Spacing
B Acceleration device
D Rotational direction
F Conveying direction
G Direction of gravity
M Coin
M' Object
X Horizontal direction
Y Vertical direction

The invention claimed is:

1. A coin separation device, comprising a conveying device comprising a conveyor belt for conveying coins in a conveying direction out of an input container along a conveying section, a testing device which is arranged on the conveying section for recognizing a coin type of a coin which is conveyed along the conveying section, and an accelerating device which is configured to accelerate a coin, while the coin is conveyed on the conveyor belt, along the conveying section in dependence on recognition by the testing device, the accelerating device comprising an acceleration element which, when the coin is determined by the testing device to be a first coin type, is accelerated in a first manner from a position in which the acceleration element is at a spacing from the coin of the first coin type to strike against the coin in such a manner that the coin is transported out of its conveying movement on the conveyor belt from the conveying section into a coin collecting device, and wherein, when the coin is determined by the testing device to be a second coin type, the acceleration element is accelerated in a second manner of acceleration which is different to the first manner of acceleration, such that the acceleration element abuts against the coin of the second coin type and applies a different type of acceleration to the coin to convey the coin from the conveying section.

2. The coin separation device as claimed in claim 1, wherein the acceleration device is configured to accelerate the coin in the conveying direction.

3. The coin separation device as claimed in claim 1, wherein the conveying section comprises a first end and a second end, wherein the input container is arranged on the first end and the acceleration device is arranged on the second end.

4. The coin separation device as claimed in claim 3, wherein the acceleration device is configured to convey a recognized coin beyond the second end into the coin collecting device on the other side of the second end.

5. The coin separation device as claimed in claim 3, wherein the coin collecting device, when viewed along the conveying direction, is at a spacing to the second end of the conveying section.

6. The coin separation device as claimed in claim 1, wherein the acceleration device comprises a stepping motor and an acceleration element which is driven by the stepping motor for accelerating a coin.

7. The coin separation device as claimed in claim 6, wherein the acceleration element is formed by a paddle wheel which is rotatable about a rotational axis and which has paddles for acting upon a coin.

8. A method for operating a coin separation device, the method comprising conveying coins, using a conveying device comprising a conveyor belt, in a conveying direction out of an input container along a conveying section, recognizing a coin type of a coin which is conveyed along a conveying section using a testing device arranged on the conveying section, accelerating a coin which is conveyed on the conveyor belt along the conveying section using an acceleration element such that, when the coin is recognized to be a first coin type, the coin of the first coin type is accelerated in a first manner from a position in which the acceleration element is at a spacing from the coin to strike against the coin in such a manner that the coin is transported out of its conveying movement on the conveyor belt into a coin collecting device, and wherein, when the coin is recognized to be a second coin type, the acceleration element is accelerated in a second manner of acceleration which is different to the first manner of acceleration, such that the acceleration element abuts against the coin of the second coin type and applies a different type of acceleration to the coin to convey the coin from the conveying section.

9. The method as claimed in claim 8, further comprising:

actuating the acceleration device in dependence on a control signal generated by the testing device for accelerating a coin which is conveyed on the conveying section.

10. The method as claimed in claim 8, further comprising:

detecting at least one of geometric and electric characteristics of the coin using a sensor device of the testing device in order to determine the coin type of the coin by way of the geometric or electric characteristics.

11. The method as claimed in claim 10, further comprising:

comparing data, using an evaluation and storage device of the testing device in which at least one currency data set with data of different coin types of a coinage is stored, of the coin detected by means of the sensor device with stored data of the at least one currency data set and by way of the comparison assigning the coin to a coin type of the currency data set.

12. The method as claimed in claim 8, further comprising:

braking the acceleration device after the acceleration.

* * * * *